US008405937B2

(12) United States Patent
Liesenberg et al.

(10) Patent No.: US 8,405,937 B2
(45) Date of Patent: Mar. 26, 2013

(54) CONTROLLER FOR PLATFORM DOORS

(75) Inventors: Kay Holger Liesenberg, Stuttgart (DE); Klaus-Peter Linzmaier, Winterbach (DE)

(73) Assignee: Siemens Aktiengesellschaft, Munich (DE)

( * ) Notice: Subject to any disclaimer, the term of this patent is extended or adjusted under 35 U.S.C. 154(b) by 40 days.

(21) Appl. No.: 12/998,464

(22) PCT Filed: Sep. 15, 2009

(86) PCT No.: PCT/EP2009/061924

§ 371 (c)(1),
(2), (4) Date: Apr. 22, 2011

(87) PCT Pub. No.: WO2010/046184

PCT Pub. Date: Apr. 29, 2010

(65) Prior Publication Data

US 2011/0197514 A1 Aug. 18, 2011

(30) Foreign Application Priority Data

Oct. 22, 2008 (DE) ..... 10 2008 052 665

(51) Int. Cl.
*B61B 7/02* (2006.01)
*B61B 1/02* (2006.01)

(52) U.S. Cl. ..... 361/1; 104/30; 105/425; 105/426; 105/427; 105/428; 105/429

(58) Field of Classification Search ..... 361/1; 104/30; 105/425, 426, 427, 428, 429, 432
See application file for complete search history.

(56) References Cited

U.S. PATENT DOCUMENTS 5,295,441 A 3/1994 Kawanishi et al.
5,845,579 A * 12/1998 Langley et al. ..... 104/31
6,023,612 A * 2/2000 Harris et al. ..... 455/127.1
6,341,563 B1 * 1/2002 Gal et al. ..... 104/28
(Continued)

FOREIGN PATENT DOCUMENTS

DE 196 25 193 12/1997
DE 10 2004 045 558 9/2005
(Continued)

OTHER PUBLICATIONS

Thomas Feser et al., "Safety at the edge of platform," ZEVrail—Glaser Annalen. Georg Siemens Verlag, vol. 129, Nov. 1, 2005, pp. 226-235.

(Continued)

*Primary Examiner* — Rexford Barnie
*Assistant Examiner* — Zeev V Kitov
(74) *Attorney, Agent, or Firm* — Staas & Halsey LLP

(57) ABSTRACT

A method and a system control platform doors that are disposed at a distance to each other corresponding to a train to be entered via the platform. In order to actuate platform doors in a simple manner such that the door system of a platform is highly available, the platform doors are divided into a plural number of groups, that adjacent platform doors are associated with different groups. Each group may be connected to at least two controllers via one respective transfer medium, that control signals of at least one controller are transferred to the platform doors via the transfer media, such that in case of failure of one controller, the functions of the failed controller are transferred to the at least second controller.

10 Claims, 2 Drawing Sheets

U.S. PATENT DOCUMENTS

| | | | | |
|---|---|---|---|---|
| 7,328,662 | B2 * | 2/2008 | Kasai et al. | 105/429 |
| 7,677,178 | B2 | 3/2010 | Ellmann et al. | |
| 7,802,251 | B2 * | 9/2010 | Kitamura | 718/1 |
| 2001/0022049 | A1 * | 9/2001 | Clark et al. | 49/360 |
| 2002/0134275 | A1 * | 9/2002 | Stiles | 104/27 |

FOREIGN PATENT DOCUMENTS

| | | | |
|---|---|---|---|
| DE | 10 2004 025 514 | | 11/2005 |
| DE | 10 2008 052 665.7 | | 10/2008 |
| JP | 2002/302032 | * | 4/2001 |
| WO | PCT/EP2009/061924 | | 9/2009 |

OTHER PUBLICATIONS

International Search Report for PCT/EP2009/061924, mailed on Dec. 23, 2009.

* cited by examiner

CONTROLLER FOR PLATFORM DOORS

CROSS REFERENCE TO RELATED APPLICATIONS

This application is based on and hereby claims priority to International Application No. PCT/EP2009/061924 filed on Sep. 15, 2009 and German Application No. 10 2008 052 665.7 filed on Oct. 22, 2008, the contents of which are hereby incorporated by reference.

BACKGROUND

The invention relates to a method and a system for controlling platform doors which are arranged at a distance from one another which corresponds to the distance between train doors of a train to be entered from the platform.

A method or a system such as this is installed in particular on frequently used platforms and in train stations with driverless vehicles. In this case, doors are installed on the platform side and prevent passengers from stepping onto the tracks when there is no train at the platform. After a train has entered, the doors are opened at the same time as the train doors, and are closed again before the train departs. The function therefore corresponds, so to speak, to the function of an inner and outer elevator door.

The functions of the doors which are used in this case can be subdivided into safety-relevant functions and non-safety-relevant functions. For example, a locking function of the door, which prevents the door from being opened when this is not intended and when there is no train at the platform, represents a safety function while, for example, the provision of a specific movement curve during opening of the door merely contributes to speeding up the processes, and could therefore be referred to as a convenience function. In addition, for example, an unintended attempt by the door drive, which could be caused by a malfunction in it, does not represent a safety risk as long as an additional safety function—such as the lock described above—prevents the door from actually being opened.

In the case of elevator doors, the safety-relevant and non-safety-relevant functions are advantageously subdivided such that the drive control or the converter for the door motor has to provide only a small number of safety functions—such as limiting the force while closing.

However, when doors are used on platforms, it cannot be assumed, as in the case of elevators, that the safe state of the door is the closed state because:

1. elevators in tall buildings are generally of redundant design, but this cannot be done with platforms because of the additional investment required for this purpose,
2. staircases are normally also provided as a redundancy for elevators, for fire protection reasons, and
3. the capability to unlock a platform door by hand (mechanically), as in the case of an elevator, results in a platform failure until the door is serviced/brought back into use again.

When an elevator fails, the building in its entirety can still be used, although possibly with restricted performance. When a platform door fails, a relevant platform is also still ready for use. In contrast, if a platform fails (at least in subway operation), train operation will in general be adversely affected.

To this extent, it is worthwhile considering the availability of individual components, in addition to distinguishing between safety-relevant and non-safety-relevant functions. A component or function may be regarded as a high-availability component or function if the intended purpose of the function or the function of the component is still ensured even after failure of an individual component or a part thereof. A system can be considered to have high availability if a single failure of a component in the system does not prevent the overall operation of the system.

The provision of the safety-relevant functions can be implemented, for example, by suitable redundancies or other measures (for example also mechanical measures), such that a failure of single components does not lead to safety-critical states. This could be implemented, for example, by the controller itself (CPU), the transmission media for the control signals (for example PROFIBUS/PROFINET/individual I/O signals) and the actuators (for example locks on each door) being of redundant design.

"Convenience functions" can also be implemented without redundancy, since a failure of functions such as these does not directly lead to unsafe states. At first sight, it is therefore sufficient to design the transmission media and the actuators in a non-redundant form. However, in this case, all the platform doors will actually fail in the event of a defect, for example of the transmission medium.

However, a failure such as this can also indirectly lead to unsafe states—such as panic breaking out in an overcrowded subway station. Furthermore, more stringent availability requirements may demand that such a total failure of the platform doors be avoided, because of lack of redundancy in train stations (since platforms are generally not available in a redundant form).

SUMMARY

One potential object is to operate platform doors in a simple manner such that the door system of a platform has high availability.

The inventors propose a method of the type mentioned initially, in which the platform doors are subdivided into a total of at least two groups, adjacent platform doors are associated with different groups, at least two controllers are provided, each group is connected via a respective transmission medium to at least one controller such that each controller is also connected to at least one group, and control signals are transmitted via the transmission media to the platform doors. The inventors also propose a related system.

The trains to be entered, for example subway trains and tramways, have a plurality of doors and—if the trains have train segments (for example "carriages" in the case of trains or "compartments" in the case of subway trains)—in general also a plurality of doors in each train segment, thus making it possible to contribute during normal operation to rapid entry and exit, with short cycle times, at the stations. Adjacent doors therefore represent at least a certain amount of redundancy for a train segment of the train to be entered (or for the train to be entered, if this does not have separate segments, although this distinction is not mentioned explicitly in every case in the following text), in which case, although the failure of individual doors does not allow passengers to pass through them in the same way as if there had been no failure, this situation is, however, in general sufficient to maintain normal operation (which can also be recognized by the fact that subway trains with individual defective doors are relatively frequently still used).

If the doors on a platform are subdivided into a total of n groups, where $n \leqq$ the number of doors within a train segment, only (n−1) redundant transmission media need be added to provide redundancy all the time. If one transmission medium now fails which, for example, has connected the first and third platform doors to the controller, then, for example, the second and fourth platform doors are still serviceable. Since the subdivision of the doors is chosen such that adjacent doors are associated with different groups, each segment of the train can still be used, despite the failure of a single component, for example if the first and second or the third and fourth doors are each associated with one segment of the train to be entered.

The resulting system for controlling platform doors therefore has high availability because a high-availability door system can be considered to have high availability if the availability of the station is not put at risk by the failure of a single component of the door system.

Furthermore, the required additional complexity is restricted to a minimum by skillful identification of natural redundancies (=a plurality of doors per train/train segment).

Further exemplary embodiments can be achieved by varying the number of groups n, in which case the adverse effects of operation of the entire station in the event of failure of one component decrease as n increases.

In one advantageous form of the embodiment, each group is connected via a respective transmission medium to at least one second controller and, if one controller fails, the functions of the failed controller are transferred to the at least one second controller. This means that the resultant door system is completely immune to failure of one controller since, in the event of a defect, the (respective) at least second controller takes over, as a result of which no group of platform doors fails because of the failure of one controller.

In a further advantageous embodiment, the train to be entered has at least two train segments which each have a number of train doors, and the number of groups is chosen to be equal to the number of train doors in each train segment. This means that only one door in each segment fails in the event of a defect in which case, nevertheless, the additional complexity for additional transmission media is still restricted to a reasonable extent.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
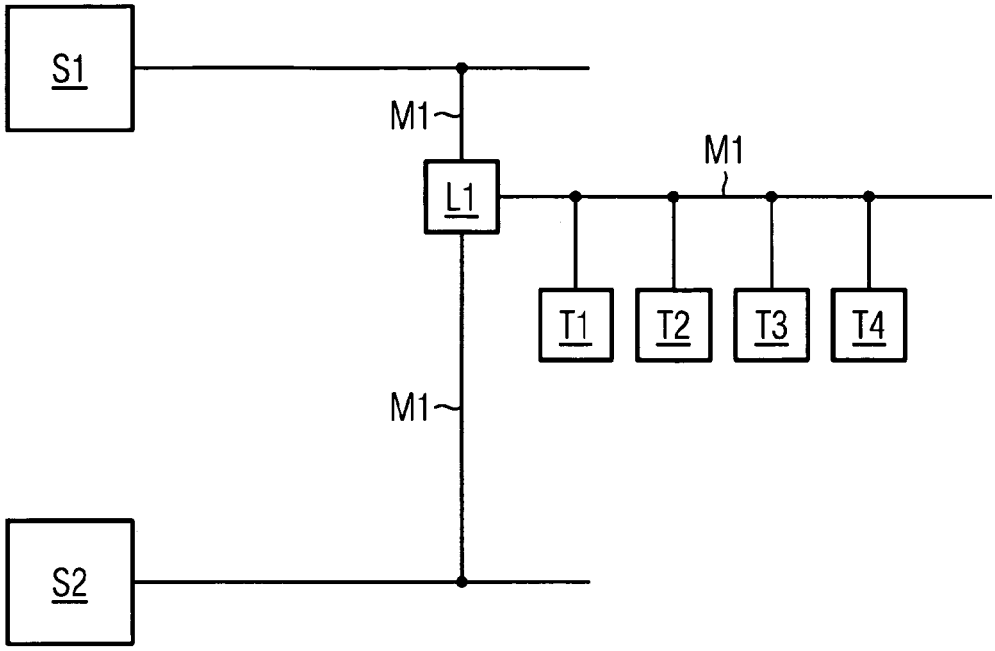
FIG. 1 shows a schematic illustration of a door system with redundant control.

Reference will now be made in detail to the preferred embodiments of the present invention, examples of which are illustrated in the accompanying drawings, wherein like reference numerals refer to like elements throughout.

FIG. 1 shows a door system with four platform doors T1-T4 which are connected via a transmission medium M1 to two controllers S1, S2. The connection of the two "control runs" to the one "door run" is made via the link L1 which, for example, may be in the form of a Y coupler. The controllers S1, S2 are redundant such that, if one controller S1, S2 fails, the safety-relevant functions can be taken over by the second controller S1, S2. The "convenience functions" can be provided without redundancy since a failure of functions such as these does not lead directly to unsafe states. A non-redundant form of the transmission medium M1 and of the actuators in the doors T1-T4 is therefore at first sight sufficient. However, all the platform doors T1-T4 will also fail in the event of failure of the Y coupler L1 or in the event of a defect in the transmission medium M1, as a result of which the platform can no longer be used at all. Since platforms in stations are generally not provided in the redundant form and, furthermore, a failure such as this can also lead indirectly to unsafe states such as panic breaking out in an overcrowded subway station, a more stringent availability requirement is demanded.

Figure 2:
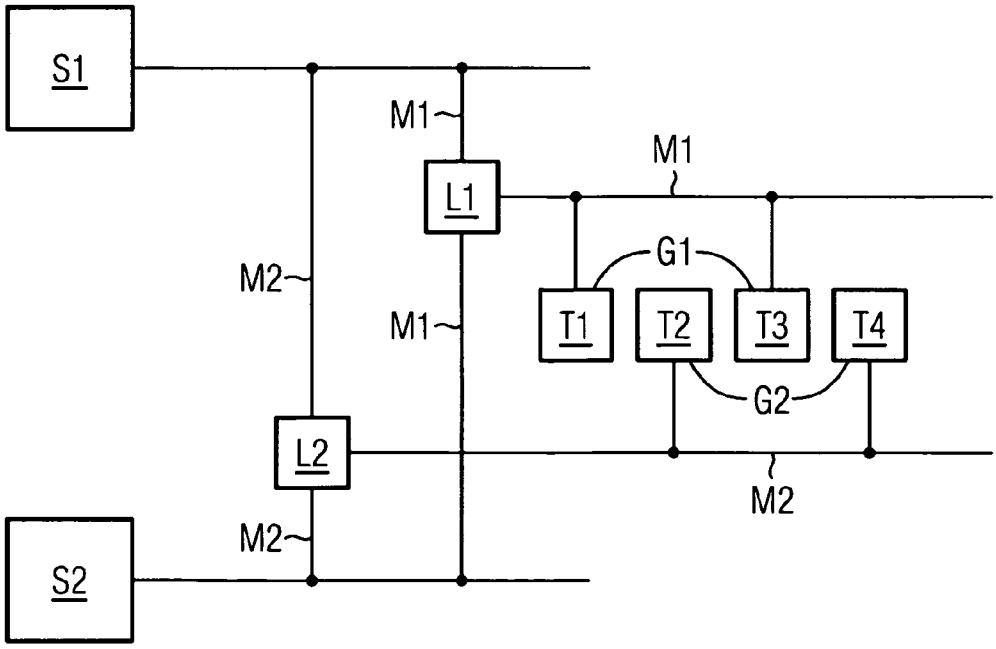
FIG. 2 shows a schematic illustration of a high-availability door system according to the invention.

FIG. 2 shows a door system similar to that shown in FIG. 1, but in which the platform doors T1-T4 are subdivided into two groups G1, G2, and both groups G1, G2 are connected via a respective transmission medium M1, M2—once again by a respective link L1, L2—to two respective (redundant) controllers S1, S2, such that a failure of one controller S1, S2 has no adverse effect on operation. In this case, the doors T1 and T3 in the first group G1 and the doors T2 and T4 in the second group G2 are associated such that adjacent platform doors T1-T4 belong to different groups G1, G2. Since a train segment (for example a carriage or compartment) of a train normally has at least two train doors, this makes it possible to maintain normal operation of the platform—although with reduced performance. In this case, the required additional complexity can be reduced to a minimum by using the redundancy which is naturally present in trains (=a plurality of train doors in each segment), since every platform door T1-T4 need not be operated redundantly, and the actuators provided in the doors T1-T4 also need not be provided redundantly.

Figure 3:
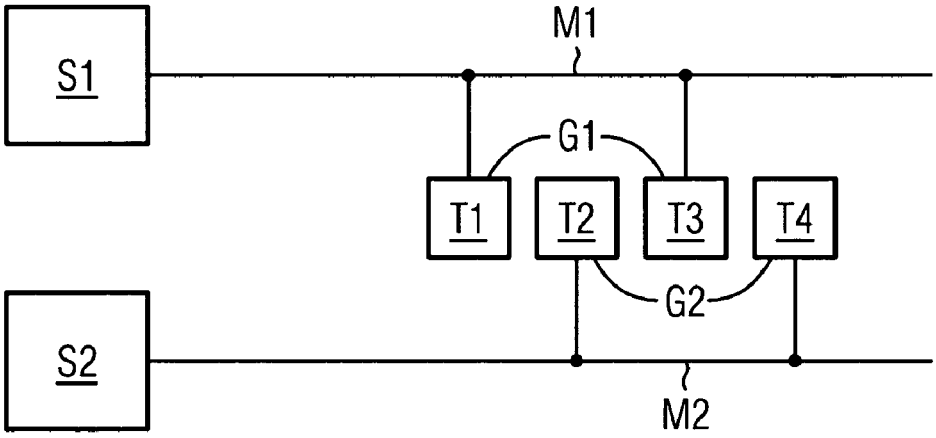
FIG. 3 shows a further embodiment of a door system according to the invention.

FIG. 3 shows a further example of a proposed door system, in which the two illustrated groups G1, G2 of platform doors T1-T4 are connected via a respective transmission medium M1, M2 to in each case only one controller S1, S2. Therefore, although the door system is no longer immune against failure of a controller S1, S2, there is, however, no need for the links L1, L2 (for example Y coupler) for connecting the groups G1, G2 to a plurality of controllers S1, S2 in each case. However, if the failure probability of a controller S1, S2 is less than that of a link L1, L2, then a failure of an entire group G1, G2 of platform doors T1-T4 in the exemplary embodiment in this figure will occur even less often than in the situation in FIG. 2, despite the simpler design.

In summary, the inventors propose a method and a system for controlling platform doors which are arranged at a distance from one another which corresponds to the distance between train doors of a train to be entered from the platform. In order to allow platform doors to be operated in a simple manner, such that the door system of a platform has high availability, it is proposed that the platform doors are subdivided into a total of at least two groups, adjacent platform doors are associated with different groups, each group is connected via a respective transmission medium to at least two controllers, control signals are transmitted from at least one controller via the transmission media to the platform doors, and that, if one controller fails, the functions of the failed controller are transferred to the at least second controller.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide* v. *DIRECTV,* 69 USPQ2d 1865 (Fed. Cir. 2004).

The invention claimed is:

1. A method for controlling platform doors which are arranged at a distance from one another which corresponds to a distance between train doors of a train to be entered from a platform, comprising:

dividing the platform doors into n groups;

associating adjacent platform doors with different groups in an alternating manner;

providing a controller for each group;

connecting each group to the controller provided for the group, via a respective transmission medium such that each controller is connected to at least one group; and transmitting control signals via the transmission media to the platform doors, wherein every $n^{th}$ door is associated with the same group.

2. The method as claimed in claim 1, wherein each group is connected via a respective transmission medium to at least two controllers, and if a first controller fails, the functions of the first controller are transferred to a second controller.

3. The method as claimed in claim 1, wherein the train to be entered has at least two train segments, each train segment has a plural number of train doors, and the number of groups is chosen to be equal to the number of train doors in each train segment.

4. The method as claimed in claim 2, wherein the train to be entered has at least two train segments, each train segment has a plural number of train doors, and the number of groups is chosen to be equal to the number of train doors in each train segment.

5. A system for controlling platform doors which are arranged at a distance from one another which corresponds to a distance between train doors of a train to be entered from a platform, comprising:

at least two controllers, the platform doors being divided into n groups with a controller provided for each group, such that adjacent platform doors are associated with different groups in an alternating manner, with every $n^{th}$ door being associated with the same group; and a transmission medium provided for each group to connect the group to the controller provided for the group, such that each controller is connected to at least one group, and control signals are transmitted via the transmission media to the platform doors.

6. The system as claimed in claim 5, wherein each group is connected via a respective transmission medium to at least two controllers such that, if a first controller fails, the functions of the first controller are transferred to a second controller.

7. The system as claimed in claim 5, wherein the train to be entered has at least two train segments, each train segment has a plural number of train doors, and the number of groups and the number of controllers is equal to the number of train doors in each train segment.

8. The system as claimed in claim 6, wherein the train to be entered has at least two train segments, each train segment has a plural number of train doors, and the number of groups and the number of controllers is equal to the number of train doors in each train segment.

9. The method as claimed in claim 1, wherein in normal operation all groups of platform doors are activated.

10. The system as claimed in claim 5, wherein in normal operation, all groups of platform doors are activated.

* * * * *